350-6.4 SR
7/4/78 XR 4,099,172

United States Patent [19] [11] 4,099,172
Montanari et al. [45] Jul. 4, 1978

[54] ELECTRONIC VISUAL DISPLAY UNIT FOR ALPHANUMERIC CHARACTERS

[75] Inventors: Lucio Montanari, Cascinette d'Ivrea (Turin); Guido Fiorentino, Ivrea (Turin), both of Italy

[73] Assignee: Ing. C. Olivette & C., S.p.A., Ivrea (Turin), Italy

[21] Appl. No.: 702,790

[22] Filed: Jul. 6, 1976

[30] Foreign Application Priority Data

Jul. 11, 1975 [IT] Italy ..... 68807 A/75

[51] Int. Cl.[2] ..... H05B 33/00; G09F 9/32

[52] U.S. Cl. ..... 340/336; 340/324 R; 340/378 R; 350/6.4

[58] Field of Search ..... 340/324 R, 336, 366 R, 340/366 B, 378 R, 378 B; 354/5, 6, 15; 350/6, 7; 178/15

[56] References Cited

U.S. PATENT DOCUMENTS

| | | | |
|---|---|---|---|
| 1,747,433 | 2/1930 | Genest | 340/343 |
| 2,070,460 | 2/1937 | Traub | 350/6 |
| 2,644,031 | 6/1953 | Klyce | 313/149 |
| 2,976,361 | 3/1961 | Stamps | 350/7 |
| 2,976,362 | 3/1961 | Stamps | 350/6 |
| 3,651,258 | 3/1972 | Ammann | 178/15 |
| 3,744,048 | 7/1973 | Treichel | 340/324 R |
| 3,820,123 | 6/1974 | Ammann | 340/378 B |

*Primary Examiner*—David L. Trafton
*Attorney, Agent, or Firm*—Schuyler, Birch, Swindler, McKie & Beckett

[57] ABSTRACT

A display using at least one LED to create at least one entire dot matrix for alphanumeric characters. This is obtained by interposing between the LED and the observer a special rotating prism of transparent material. Two of the opposite faces of the prism are parallel to the axis of rotation, two other faces are inclined with respect to said axis of an angle $\alpha$, while the remaining two faces are inclined with respect to the same axis of an angle $2\alpha$. In consequence of the rotation of the prism and of the different inclination of its faces, the virtual image of the LED is successively positioned at all of the points of a matrix of 5 columns. The turning on of the LEDs of the display is synchronized with the rotation of the prism by means of a sensing device cooperating with a strobe wheel and the emitted light is modulated according to the desired character, so that for each LED a full alphanumeric character is displayed according to a dot matrix.

13 Claims, 26 Drawing Figures

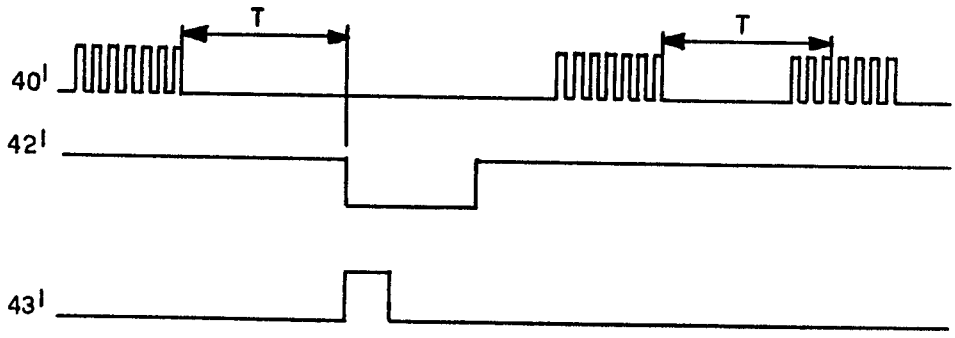
FIG. 6
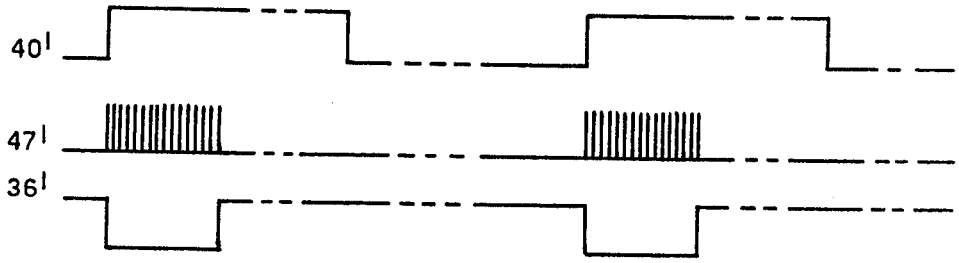
FIG. 7
FIG. 9
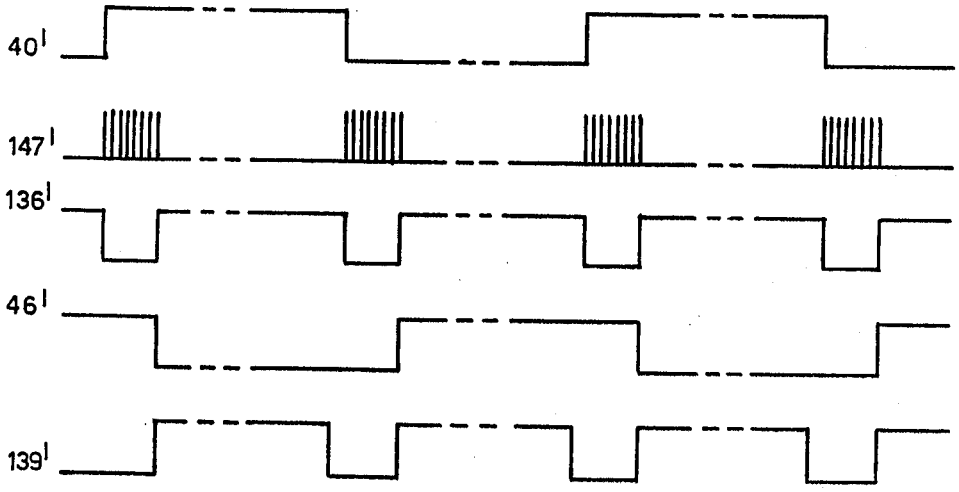

FIG. 11a
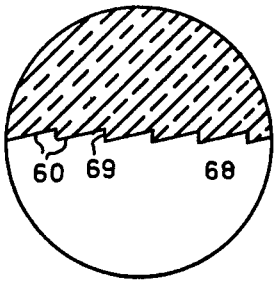
FIG. 11b
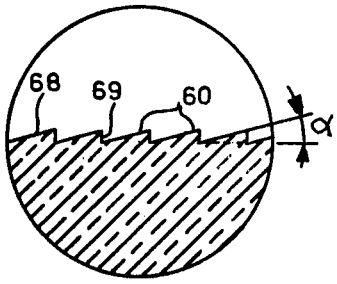
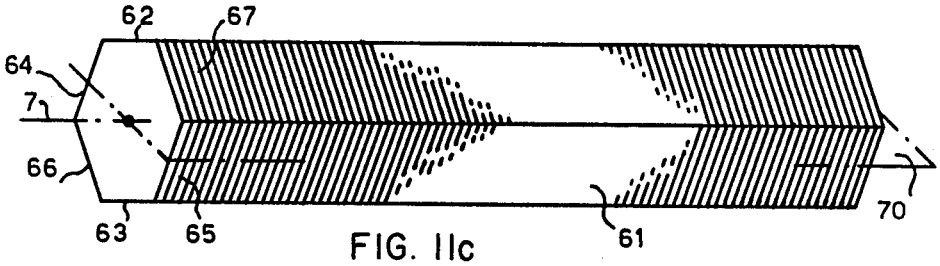
FIG. 11c
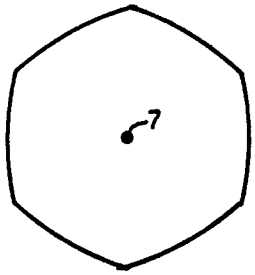
FIG. 12 a
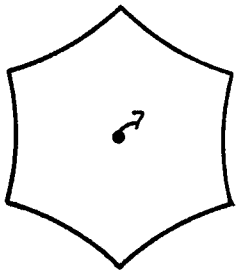
FIG. 12 b

ELECTRONIC VISUAL DISPLAY UNIT FOR ALPHANUMERIC CHARACTERS

BACKGROUND OF THE INVENTION

This invention relates to a visual display unit for alphanumeric characters. Visual display units for alphanumeric characters find wide use in electronic computers as well as in other information processing and display systems.

DESCRIPTION OF THE PRIOR ART

Some visual display units for alphanumeric information are known wherein the characters to be visually displayed are formed by using dot matrices, for example by employing light emitting diodes, hereinafter referred to by the name LED, or discharge in a rarefied gas, these units being hereinafter referred to as "plasma" visual display units, or liquid crystal devices.

A common characteristic of known LED and plasma visual display units is that of using a separate source of modulated light for each of the dots of the matrix of every one of the characters which is to be visually displayed, and, in liquid crystal visual display units, that of modulating the light separately at each of the said dots. These solutions, which are very simple in concept, result in high cost of the visual display unit, in terms both of components required for the construction thereof and of the driving circuits and the corresponding connections necessary for operation.

The dot matrices commonly used for the formation of the alphanumeric characters comprise 35 dots disposed in seven rows and five columns; for alphanumeric visual display units, the simultaneous display of at least 16 characters is normally required, which correspond to a total of 560 dots. The known expedients of multiplex driving and of autoscanning systems enable these drawbacks to be reduced only in part.

Visual display units for alphanumeric characters are also known which utilize as the sole source of modulated light the spot of a cathode ray tube which is given a scanning movement, but these visual display units do not solve the economic problem both because of the high inherent cost of the components and because of the complexity of circuitry; they are, moreover, very bulky and incompatible with present-day integrated systems, because they require very high supply and driving voltages.

SUMMARY OF THE INVENTION

According to the present invention, there is provided a visual display unit for displaying a plurality of alphanumeric characters in accordance with dot matrices, comprising a plurality of light sources smaller in number than the total number of dots of the matrices, a scanning arrangement operative to displace a potentially visible dot from each light source to coincide in succession with a plurality of dot positions pertaining to one or more matrices, and a control circuit operable in synchronism with the scanning arrangement and under the control of signals to be displayed so to modulate the light from the sources that each selectively displays and does not display dots at its dot positions in accordance with the character to which the dots pertain.

According to another aspect of the invention, the said elements have a rotary movement and comprise prismatic elements interposed in the path of the rays proceeding from the said sources of modulated light, whereby they cause the formation of virtual images of the character matrices.

According to a further aspect of the invention, the said elements having a rotary movement include the movable electrodes of a plasma tube, the said electrodes being positioned to produce selectively punctiform luminous discharges with respect to fixed electrodes disposed inside the same plasma tube.

BRIEF DESCRIPTION OF THE DRAWINGS

The invention will be described in more detail, by way of example, with reference to the accompanying drawings in which:

FIG. 6 is a diagram of a number of waveforms of the driving circuit of FIG. 5;

FIG. 7 is another diagram of a number of waveforms of the driving circuit of FIG. 5;

FIG. 9 is a diagram of a number of waveforms of the driving circuit of FIG. 8;

FIGS. 11*a*, 11*b* and 11*c* show an alternative embodiment of the transparent prismatic element of FIG. 1;

FIGS. 12*a* and 12*b* show sections of possible alternative prismatic elements;

DESCRIPTION OF THE PREFERRED EMBODIMENT

Figure 1:
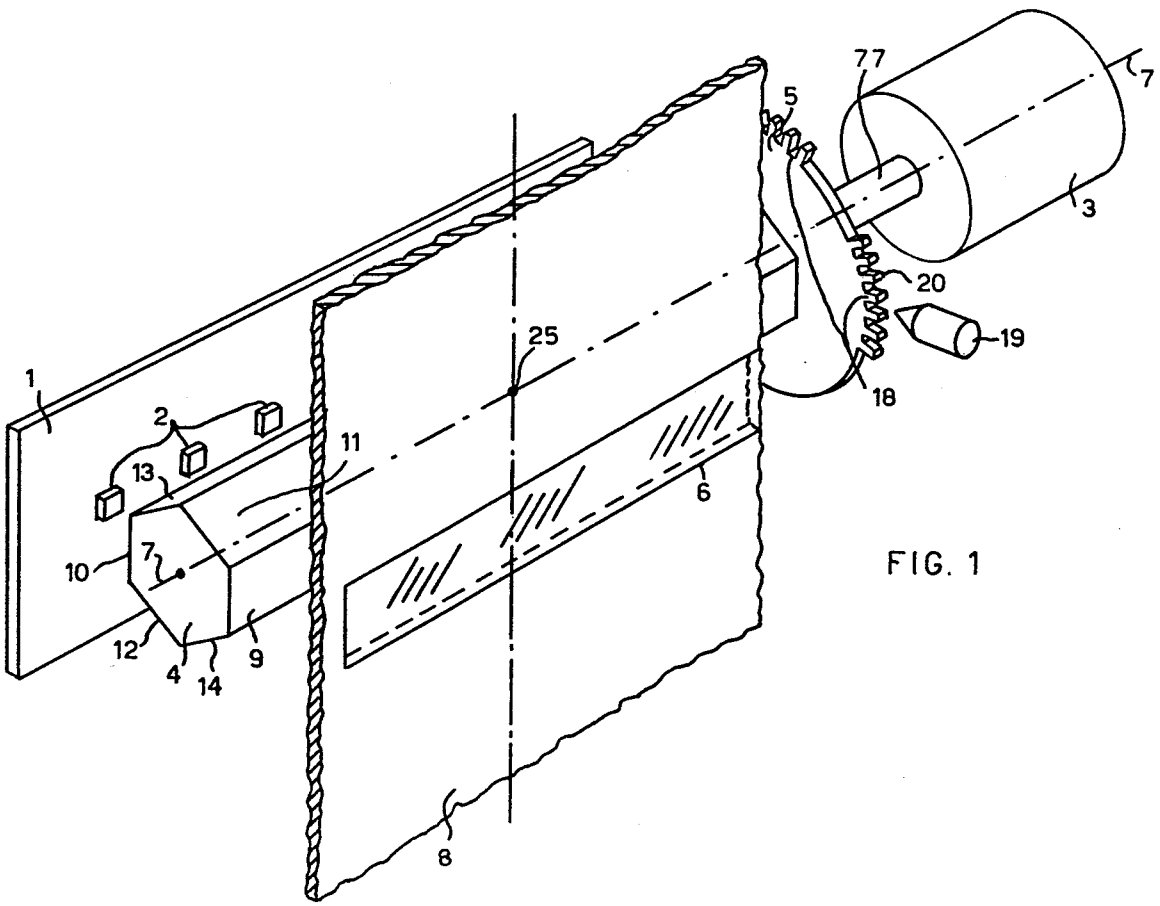
FIG. 1 shows in axonometric form a visual display unit embodying the invention with a rotating transparent prismatic element.
Figure 2A:
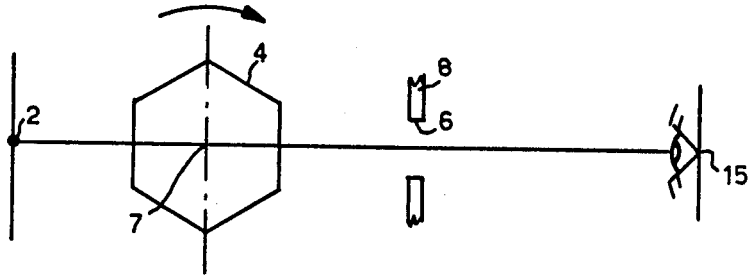
FIGS. 2*a*, 2*b* and 2*c* contain a series of diagrammatic side views of the visual display unit of FIG. 1.
Figure 2B:
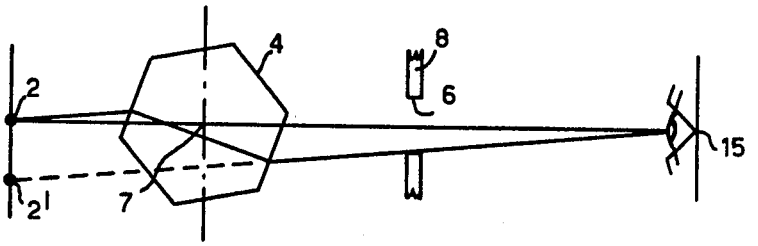
Figure 2C:
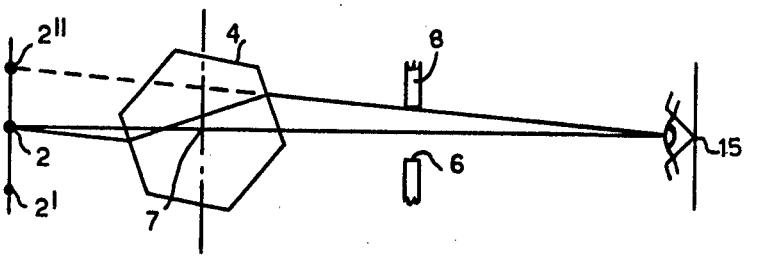

FIG. 1 shows the arrangement of the elements in a first embodiment of a visual display unit according to the invention which uses a single modulated-light generator constituted by a LED 2 for each of the alphanumeric characters to be visually displayed. In the drawing, a plate 1 supports the LEDs 2 disposed in a single line with a centre-to-centre distance equal to that desired between the characters to be visually displayed. The LEDs 2 are substantially point light sources which have particularly favourable cost and response-time characteristics; their power consumption is very low and the voltages required permit the supply thereof together with the logic circuits.

The visual display unit includes a motor 3, for example of the induction type and therefore without brushes, which keeps a transparent prismatic element 4 fast with a synchronizing disc 5 keyed on the shaft 77 of the motor 3 in rotation at substantially constant speed.

The visual display is observed through an elongated window 6 of transparent material, this being possible reflection-preventing, which is formed in an opaque guard 8 disposed parallel to the plane of support 1 of the LEDs 2. The longer axis of the window 6 is disposed in the same plane as the LEDs 2 and the axis of rotation 7 of the transparent prismatic element 4.

Figure 4:
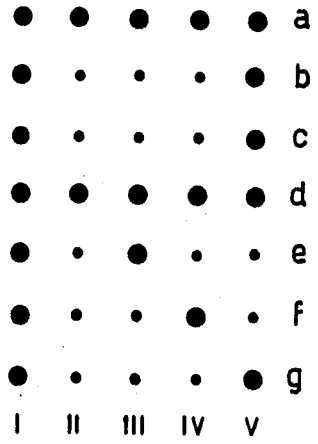
FIG. 4 shows the dot matrix of an alphanumeric character.

The transparent prismatic element 4, which is constructed of material having a high refractive index, such as, for example, a polymethyl methacrylate plastics material, is interposd between the eye of the person observing the visual display and the LEDs 2. The transparent prismatic element 4 is kept in rotation by the motor 3 and is shaped in such manner as to transform the image of a single LED 2 into the virtual image of an alphanumeric character matrix composed of 35 dots (FIG. 4).

To this end, in the transparent prismatic element 4 only the section taken at the central point 25 of the element itself perpendicularly to the axis of rotation 7 is in the form of a regular hexagon. The opposite faces of the said transparent prismatic element 4, namely 9 - 10, 11 - 12, 13 - 14, which are parallel to each other, are not, on the other hand, all parallel to the axis of rotation 7. The faces 9 - 10 are parallel to the axis of rotation 7 but the faces 11 - 12 form an angle $\alpha$ with the axis of rotation 7 and the faces 13 - 14 form a larger angle $\beta$. The reasons for the inclination of the faces 11, 12, 13, 14, will become apparent from what follows.

FIGS. *2a, 2b* and *2c* show a section taken at the central point 25 of the transparent prismatic element 4 in three different positions which it adopts during the rotation about the axis 7. When the said central section of the transparent prismatic element 4 is in the position indicated in FIG. *2a*, the eye 15 of the observer sees the source of modulated light 2 in its real position 2.

With the rotation of the transparent prismatic element 4 in the direction indicated by the arrow, owing to the effect of the refraction produced by the prismatic element the virtual image of the LED 2 shifts downwardly, following a vertical line perpendicular to the axis of rotation 7 of the transparent prismatic element 4, at a substantially uniform speed tied to the speed of rotation of the transparent prismatic element 4 until it reaches a maximum point 2', after which it moves out of the range of visibility represented by the limits of the window 6 of the opaque guard 8 (FIG. *2b*). As the rotation of the transparent prismatic element 4 continues, the virtual image of the LED 2 becomes visible again at the point 2'' symmetrical with respect to the point 2' (FIG. *2c*), from which it resumes the apparent downward movement.

The apparent shifting of the virtual image of the LEDs 2 along a vertical line is repeated six times for each complete rotation of the transparent prismatic element 4 about the axis of rotation 7, in correspondence with the passage of each of its faces 9, 10, 11, 12, 13, 14 between the eye 15 and the LED 2. Each of the vertical segments of amplitude 2' - 2'' which are apparently covered by the virtual image comprises a column of dots of the character matrix.

If the faces of the transparent prismatic element 4 were parallel to the axis of rotation, the images of the six columns successively produced would appear superimposed on one another. This does not happen because the three pairs of faces 9 - 10, 11 - 12, 13 - 14 opposite and parallel to each other have a different inclination with respect to the axis of rotation 7, as is apparent from FIG. 3, in which the inclinations of the faces are deliberately exaggerated for greater clarity. FIGS. *3a, 3b, 3c, 3d* and *3e* show the visual display unit of FIG. 1 in a projection at right-angles to that of FIG. 1 in four different positions of the transparent prismatic element 4 during its rotation about the axis 7 and at the moment when the virtual image of the source of modulated light 2 is not shifted in the vertical direction with respect to its actual position.

For the purpose of obtaining the visual display of character matrices comprising five columns of dots (FIG. 4), the faces 9 - 10 are parallel of the axis of rotation 7 (FIG. *3a*), while the faces 11 - 12 are inclined by the angle $\alpha$ and the faces 13 - 14 are inclined by the angle $\beta$. When the ray 2 - 15 passes through the faces 9 - 10, it does not undergo any deflections in the horizontal plane; equally, it does not undergo any deflection when the transparent prismatic element 4 has performed a rotation of 180° (this position is not shown in the drawing), during which the positions of the faces 9 and 10 with respect to the axis of rotation 7 are merely exchanged. On the other hand, when the transparent prismatic element 4 is in the position indicated in FIG. *3b*, because of the inclination $\alpha$ of the faces 11 and 12 with respect to the axis of rotation 7 the virtual image of the LED 2 appears at the point 30, which is shifted to the left in the horizontal plane with respect to the point 2. The inclination $\beta$ (FIG. *3c*) with respect to the axis of rotation 7 of the faces 13 and 14 which show themselves thereafter is still greater, as a result of which the virtual image of the LED 2 appears at 31, which is shifted still more to the left with respect to the real position 2.

In the following position (not shown), as already mentioned, the virtual image returns into coincidence with the real image 2. In the subsequent position (FIG. *3d*), the exchange of the positions of the faces 11 and 12 with respect to the axis of rotation 7 involves the deflection of the virtual image of the LED 2 to the right to the point 32, at an equal distance from the point 2 with respect to the point 30 (FIG. *3b*), but in a symmetrical position. The same is valid as regards the last position (FIG. *3e*), which involves the deflection of the virtual image of the LED 2 to the point 33 equidistant from the point 2 and symmetrical with respect to the point 31 (FIG. *3c*).

It is obvious that with this arrangement, owing to the rotation of the transparent prismatic element 4 about the axis of rotation 7, the virtual image of the LEDs 2 apparently moves along five vertical columns, the projection of which corresponds to the points 2, 30, 31, 32, 33 and which are covered in succession, the central column being covered twice, for each rotation of the transparent prismatic element 4. It is also obvious how it is possible in this way to utilize a single LED 2 to obtain a character matrix comprising five columns. The same consideration applies as regards all the LEDs 2 of the visual display unit.

If, at this point, the light emitted by the LED 2 is modulated in synchronism with the rotation of the transparent prismatic element 4 and as a function of the character to be visually displayed, it is possible to obtain the visual display of a complete character constituted by a matrix of dots. The synchronization is obtained through the medium of the synchronizing disc 5 of ferrous material keyed on the same axis of rotation 7 as the motor 3 and the transparent prismatic element (FIG. 1). The periphery of the said synchronizing disc 5 bears 35 teeth grouped in five groups 18 of seven equidistant teeth, with the axes of each of the groups of seven teeth 18 disposed at regular intervals of 60° along the periphery of the synchronizing disc 5; between the axis of the fifth group of teeth 18 and that of the first, on the other hand, there is an interval of 120° (see also FIG. 5).

The passage of the teeth of the groups of teeth 18 during the rotation of the synchronizing disc 5 is detected by a magnetic detector 19. The pulses of the magnetic detector 19 give the timing for the formation of the virtual matrix of 35 dots (7 rows and 5 columns). The illumination or non-illumination of the LEDs 2 in correspondence with each of these dots is determined by the particular character to be visually displayed.

Figure 3A:
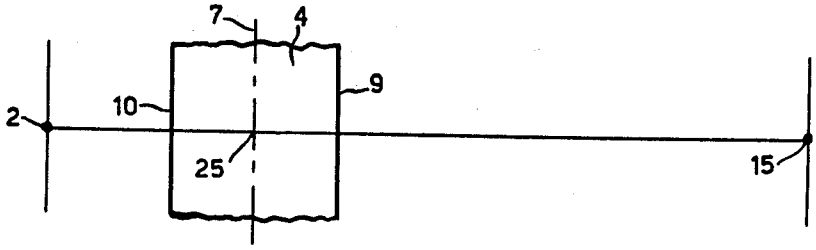
FIGS. 3*a*, 3*b*, 3*c*, 3*d* and 3*e* contain a series of plan views of the visual display unit of FIG. 1.
Figure 3B:
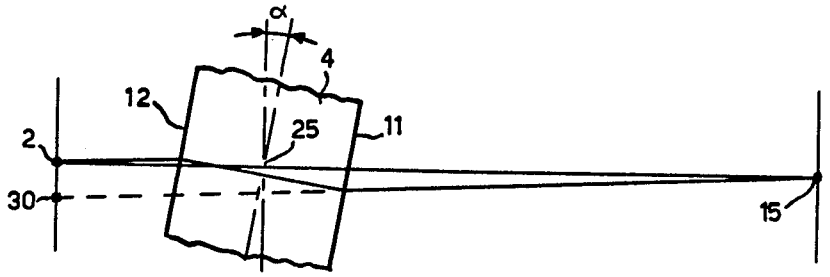
Figure 3C:
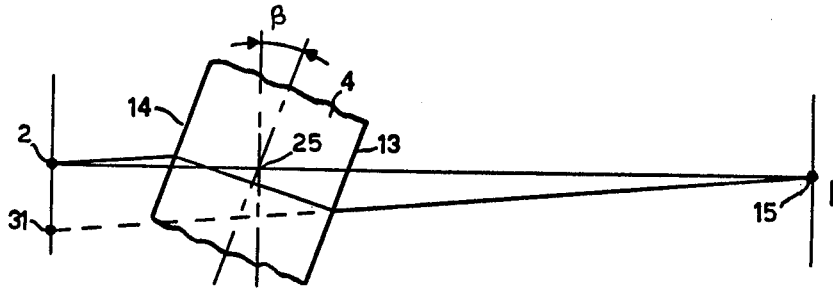
Figure 3D:
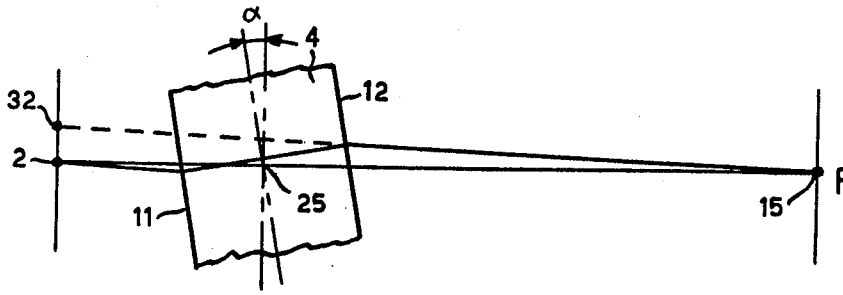
Figure 3E:
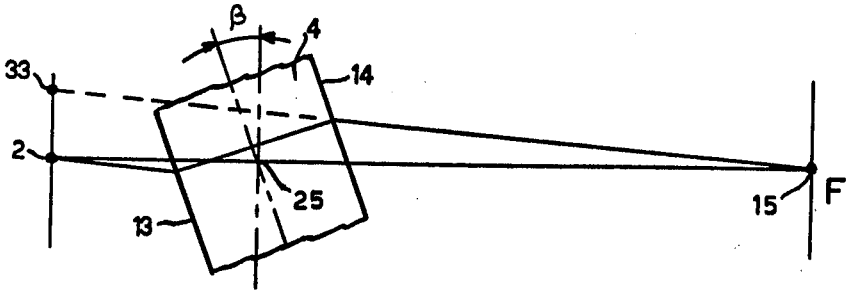

If the central tooth 20 of the first of the five groups of seven teeth 18 of the synchronizing disc 5 passes in front of the magnetic detector 19 when the prismatic element 4 is in the position shown in FIG. 3*d*, the 7 dots of column IV of the character matrix (FIG. 4) are in the visual display phase; on the passage of the second group of teeth 18, the transparent prismatic element 4 is in the position of FIG. 3*e* giving visual display of the dots of column V of the matrix (FIG. 4), and so on, with visual display of the seven dots of column III in correspondence with position 3*a*, of those of column II in correspondence with the position of FIG. 3*b* and of those of column I in correspondence with the position of FIG. 3*c*.

In correspondence with the passage of the transparent prismatic element 4 through the subsequent position, which is symmetrical with the position of FIG. 3*a*, the sector of the synchronizing disc 5 is devoid of the teeth 18 and therefore no signal is induced in the detector 19. On such passage, therefore, illumination of the LEDs 2, the image of which would come to coincide afresh with the central column (III) of the matrix of FIG. 4, is completely obviated. In accordance with what has been explained hereinbefore, the absence of the teeth 18 in the said sector of the synchronizing disc 5 is employed for the phasing of the driving circuit of the visual display unit with respect to the rotation of the transparent prismatic element 4.

In order that the virtual image of the modulated-light generator 2 produced by the rotation of the transparent prismatic element 4 may appear as a single character in matrix form, it is sufficient that the speed of rotation of the transparent prismatic element 4 and the corresponding frequency of modulation of the LEDs 2 be such as to exploit the persistence of images in the eye.

Satisfactory results have been obtained with a visual display unit with a capacity of 16 alphanumeric characters according to FIG. 1, in which the LEDs 2 were of type 245 CQY of Philips and the motor 3 was a two-pole asynchronous motor with a speed of rotation of 45 revolutions/sec., corresponding to a frame frequency also of 45/sec. With an angle of 5° between each of the seven teeth of the groups of teeth 18 of the synchronizing disc 5, the basic frequency of scanning of the dots of the character matrix is $360/5 \times 45 = 3240$ Hz. With a centre-to-centre distance of 3.6 mm between the sixteen LEDs 2, the length of the transparent prismatic element 4 is about 60 mm; the distance between two opposite faces of the said element is 27 mm, the centre-to-centre distance between the said element and the LEDs 2 is about 25 mm and the angles $\alpha$ and $\beta$ (shown in FIGS. 3*a* – 3*e*) are 4° and 8°, respectively.

Figure 5:
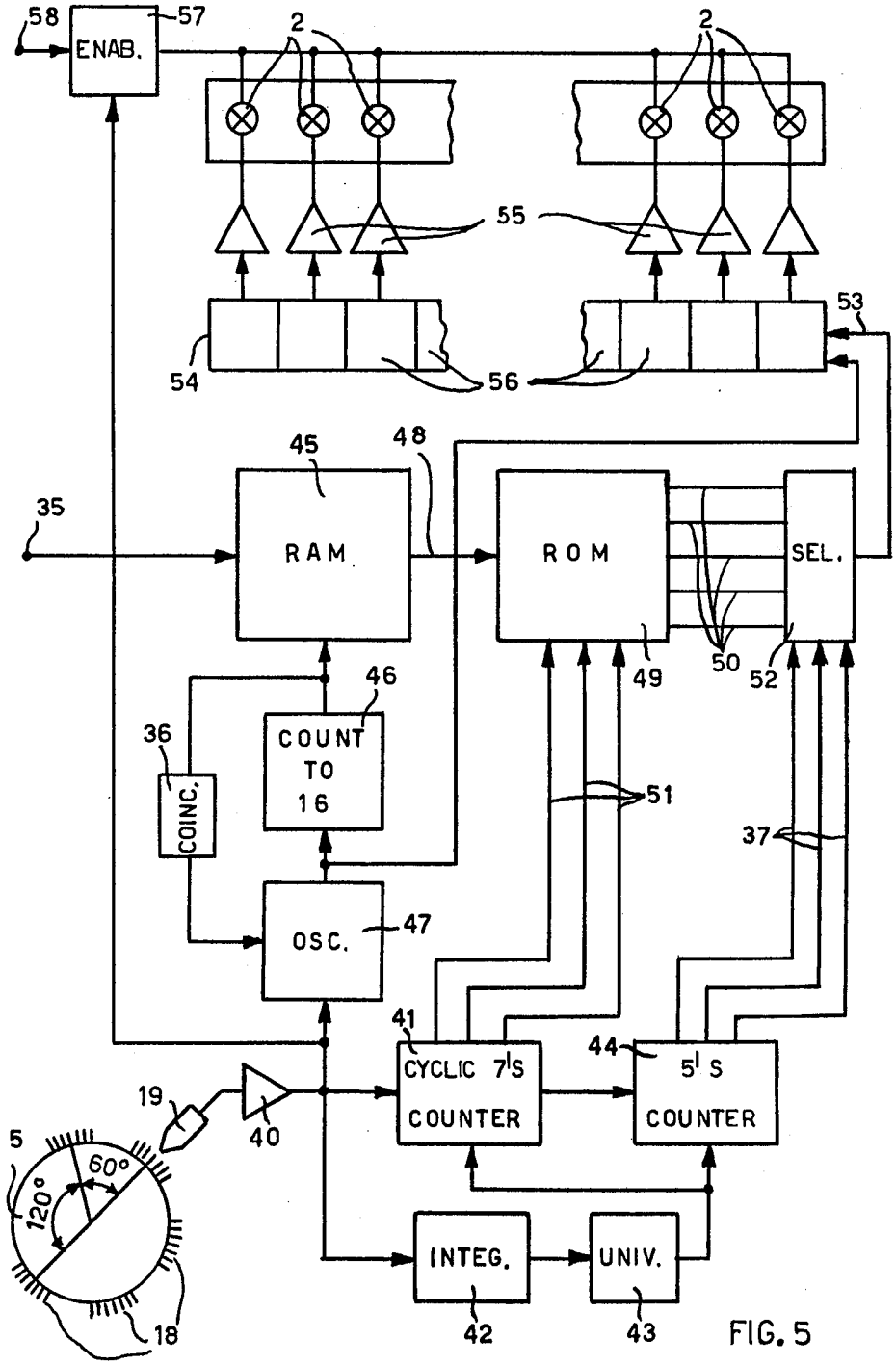
FIG. 5 is a block diagram of the driving circuit of the visual display unit of FIG. 1.

The block diagram of the driving circuit of the visual display unit described is given in FIG. 5. The drawing shows diagrammatically the synchronizing disc 5 with the groups of teeth 18 and the magnetic detector 19. The pulses of the magnetic detector 19 are amplified and squared by an amplifying and squaring circuit 40 (40' in FIG. 6) and counted by a cyclic sevens counter 41 followed in cascade by a fives counter 44. At the same time, the pulses are sent to a high-frequency oscillator 47 and to an integrating circuit 42, the object of which is to recognize the passage in front of the magnetic detector 19 of the sector of the synchronizing disc 5 which is devoid of the groups of teeth 18. The said integrating circuit 42 passes from the logical 0 state to the logical 1 state as soon as it receives a pulse squared by the amplifying squaring circuit 40 and tends to return to the logical 0 state after about a time of 4 ms after it has received the last pulse. It will, therefore, not be able to return to the logical 0 state except in correspondence with the said sector of the synchronizing disc which is devoid of teeth. The situation is illustrated in FIG. 6, in which 40' represents the signal produced by the amplifying and squaring circuit 40 and 42' represents the output voltage of the integrating circuit 42.

The return of the integrating circuit 42 to the logical 0 state triggers a univibrator 43, which generates a square synchronzing signal 43' (FIG. 6) zeroizing the cyclic sevens counter 41 and the fives counter 44, so as to bring the count into phase with the position of the synchronizing disc 5.

The data to be visually displayed comes serially from an input channel 35 (FIG. 5) and is stored in a random access memory 45, hereinafter called the RAM. The capacity of the RAM 45 is 16 6-bit characters, making a total of 96 bits. The successive characters arriving through the input channel 35 are stored at addresses increasing from 1 to 16.

The high-frequency oscillator 47 has an inherent oscillation frequency of the order of 1 MHz, compatible with the addressing times of the RAM 45 and much higher than the frequency of scanning of the dots of the matrix (3240 Hz). The oscillator 47 initiates its oscillation (47', FIG. 7) at the leading edge of the pulse generated by the amplifier 40 (40', FIG. 7) and is blocked after 16 oscillations by a counter 46 connected to it through a coincidence circuit 36 (36', FIG. 7). The coded outputs of the counter 46, which are applied to the interrogating inputs of the RAM 45, cause the appearance in succession at the output 48 of the RAM 45, in correspondence with the sixteen count positions, of the 16 codes corresponding to the 16 characters to be visually displayed, for a duration of about 1 $\mu$s each.

The output 48 of the RAM 45 is directly connected to the input of a decoding read-only memory 49, hereinafter called the ROM. In correspondence with any coded input combination, the ROM 49 provides the coding for the visual display of the corresponding character in a matrix of 35 dots (7 rows and 5 columns) (FIG. 4). The ROM 49 has five column outputs 50 and three enabling inputs 51 for the selection of the row of the matrix by means of a coded signal. In correspondence with the coded input signal 001, for example, the decoded signals for the visual display of the first row of the character matrix (*a*, FIG. 4) appear on the five column outputs 50 of the ROM 49; in correspondence with the coded signal 111 the decoded signals for the visual display of the seventh row of the character matrix (*g*, FIG. 4) appear on the outputs.

The five column outputs 50 of the ROM 49 are connected to the input of a selector logic circuit 52 commanded by the coded outputs 37 of the fives counter 44. The selector logic circuit 52 allows the presence on the input 53 of a shift register 54 of only one of the five output signals present on the five outputs 50 of the ROM 49, on the basis of the count position of the fives counter 44.

The fives counter 44, connected in cascade with the sevens counter 41, advances by one unit at the end of the passage of each of the groups of teeth 18 and serves to effect the allocation of the column signals of the outputs 50 of the ROM 49 to the five columns of the visual display, in synchronism with the shifting of the virtual image of the source of modulated light 2 produced by the rotation of the transparent prismatic element 4.

In conformity with what has been stated, in correspondence with the first count position, the selector logic circuit 52 will enable the output of the signals corresponding to column IV of the matrix, in correspondence with the second position the output of the signals of volumn V, in correspondence with the third position the output of the signals of column III, in correspondence with the fourth position the output of the signals of column II and in correspondence with the fifth position the output of the signals of column I. The succeeding selection of the rows of the column which is also involved is determined, on the other hand, by the position of the cyclic sevens counter 41 connected to the enabling input 51 of the ROM 49, which performs a complete count cycle on the passage of each of the groups of seven teeth 18 in front of the magnetic detector 19.

The shift register 54 comprises sixteen one-bit cells 56, as many as there are characters to be visually displayed. The advance in the shift register 54 of the signals to be visually displayed for the sixteen successive characters, which are generated by the ROM 49 and selected by the selector logic circuit 52, is produced by the same sixteen pulses 47' (FIG. 7) which produce the successive interrogation of the sixteen addresses of the RAM 45, in correspondence with the leading edge of the pulse 40' produced by the amplifying and squaring circuit 40 for each of the seven teeth of the groups of teeth 18 of the synchronizing disc 5 (FIG. 5).

At the end of the said sixteen pulses 47', within a time of 16 $\mu$s, which is negligible for the purposes of visual display, there are present in parallel in each of the sixteen cells 56 of the shift register 54 the codes relating to the same dot of the matrix for each of the sixteen corresponding characters to be visually displayed. The sixteen cells 56 of the shift register 54 are directly connected to sixteen amplifiers 55 driving as many LEDs 2.

The duration of lighting of the LEDs 2 is determined by an enabling circuit 57 interposed in the common supply 58 of the LEDs 2. In dependence upon the 0 state (extinguished) or 1 state (lit) of the bits present in the cells 56 of the shift register 54, the enabling circuit 57 permits the lighting of the LEDs 2 throughout the time that the pulse 40' (FIG. 7) generated by the amplifying and squaring circuit 40 is at a low level and which corresponds to a little less than one half of the time elapsing between the passage of two successive teeth of the seven teeth of the groups of teeth 18 of the synchronizing disc 5.

It is, therefore, obvious how the individual LEDs 2 of each of the characters to be visually displayed, the virtual image of which appears successively in the 35 dots of a matrix of 7 rows and 5 columns owing to the rotation of the transparent prismatic element 4, are driven in synchronism with the rotation of the transparent prismatic element 4 in such manner as to form the virtual image of the sixteen characters corresponding to the coded data to be visually displayed which is stored in the RAM 45 and transcoded by the ROM 49. The circuit described is particularly simple to produce, inasmuch as all the elements it comprises, including the RAM 45 and the ROM 49, may be standard integrated circuits.

Figure 8:
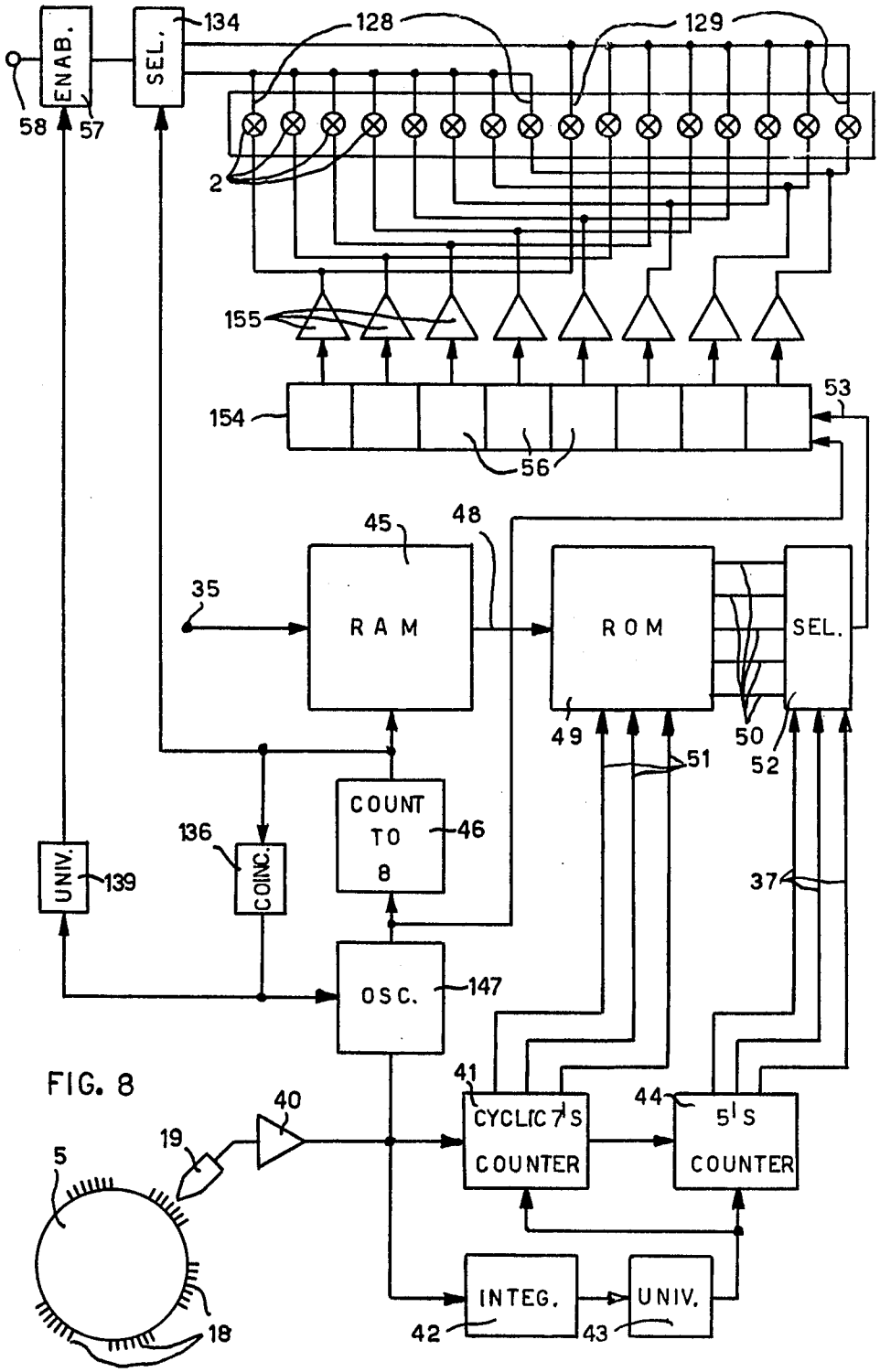
FIG. 8 shows a modified form of the driving circuit of FIG. 5.

The number of components required for the visual display unit may be further reduced by driving the LEDs in multiplex. FIG. 8 is a block diagram relating to a driving circuit multiplexed in two's; such multiplexing is possible because owing to the virtual formation of the character matrix the LEDs 2 must be kept lit in correspondence with the illuminated dots for a time less than one half of the time elapsing between the scanning of two successive dots of the matrix.

The circuit of FIG. 8 is a modified form of that of FIG. 5, from which it differs only as regards the circuits connected with the driving of the LEDs 2 and to the description of which reference will therefore be made as regards those features which are common to the two circuits. In the circuit of FIG. 8, the sixteen LEDs 2 of the visual display unit of FIG. 1 are divided into two groups of eight, 128 and 129. The high-frequency oscillator 147 differs from the oscillator 47 of FIG. 5 corresponding thereto only in that it initiates its oscillations (147', FIG. 9) both at the leading edge and at the trailing edge of the pulses generated by the amplifier 40 (40', FIG. 9), and in that it is blocked after eight oscillations (instead of sixteen) by the coincidence circuit 136 (136', FIG. 9).

With this arrangement, the interrogation of the RAM 45 takes place, as regards the first group of eight of the sixteen characters to be visually displayed, following the leading edge of the pulse produced by the amplifying and squaring circuit 40 on the passage of each of the teeth of the groups of teeth 18 of the synchronizing disc 5 (40', FIG. 9), and, as regards the second group of eight of the said sixteen characters to be visually displayed, following the trailing edge of the said pulse 40'.

The signals corresponding to the said first group of eight of the sixteen characters to be visually displayed are successively stored in the eight one-bit cells 56 of the shift register 154, which is similar to the shift register 54 of FIG. 5 except for the number of one-bit cells 56, which is eight instead of sixteen. The eight one-bit cells 56 of the shift register 154 are directly connected to as many amplifiers 55 for driving the LEDs 2, which are like those of the circuit of FIG. 5. The duration of lighting of the LEDs 2 is determined by a univibrator 139 which, for each blocking pulse 136' (FIG. 9) of the blocking circuit 136, generates a pulse 139' (FIG. 9) with a duration a little less than that elapsing between leading and trailing edges of the pulses 40' generated by the amplifying and squaring circuit 40. The pulse 139' enables the circuit 57 for the passage of the current supplying all the LEDs 2. A selector circuit 134, which is commanded by the most significant bit 46' (FIG. 9) of the eight counter 46, permits the lighting of the eight LEDs 2 of the first group 128 of eight LEDs 2 during the time following the rise of the pulse 40' generated by the amplifying and squaring circuit 40, in dependence upon the contents of the cells 56 of the shift register 54, which contains the data relating to the characters to be visually displayed by means of the first group 128 of eight LEDs 2, and, on the other hand, permits the lighting of the eight LEDs 2 of the second group 129 of eight LEDs 2 during the time following the fall of the pulse 40' generated by the amplifying and squaring circuit 40, when the cells 56 of the shift register 54 contain the data to be visually displayed relating to the characters to be visually displayed by means of the second group 129 of eight LEDs 2.

The operation of the circuit of FIG. 8 becomes obvious with the aid of the diagrams of FIG. 9 and from comparison with those of FIG. 7 relating to the non-multiplexed circuit of FIG. 5.

Because of the phase difference in the lighting, which is really very small, the images of the LEDs 2 belonging to the first of the two groups, the group 128, of eight LEDs 2 would appear slightly shifted in the vertical direction with respect to those of the LEDs 2 belonging to the second group 129 of eight LEDs 2. If desired, this shift may be compensated by shifting the actual position in the vertical direction of one group with respect to the other by the same amount in the opposite direction on mounting the LEDs 2 on the plate 1 of FIG. 1.

Figure 10:
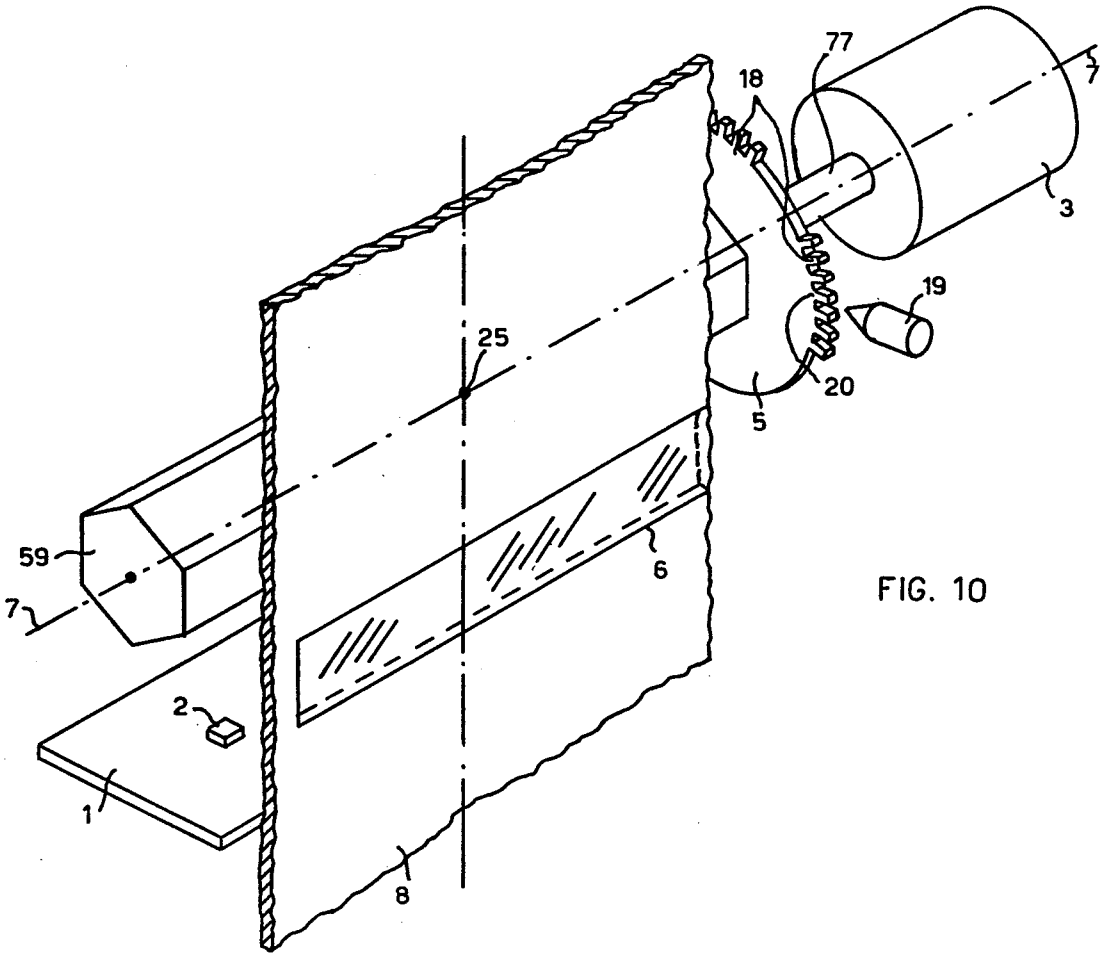
FIG. 10 shows in axonometric form another visual display unit embodying the invention with a rotating prismatic mirror.

According to another embodiment, the transparent prismatic element 4 of FIG. 1 is replaced by a similarly shaped rotating prismatic mirror 59, for example using the arrangement shown in FIG. 10. The rotating prismatic mirror 59 acts by reflection, instead of by refraction, to create the virtual image of a complete character using a single LED 2. For the rest, all that has been said in in connection with the visual display unit of FIG. 1 applies as regards the visual display unit of FIG. 10.

Another particularly interesting modification of the solution of FIG. 1 consists in replacing the transparent prismatic element 4 shaped as described by a substantially regular transparent hexagonal prism like that 61 shown in FIG. 11*c*. All the faces of the transparent hexagonal prism 61 are generally parallel to the axis of rotation 7. At least some of the faces, however, are grooved in prismatic grooves, as a result of which the optical behaviour as a whole of the transparent hexagonal prism 61 is entirely equivalent to that of the transparent prismatic element 4.

More particularly, the opposite faces 62 - 63 of the transparent hexagonal prism 61 are plane and equivalent to the faces 9 - 10 of the transparent prismatic element 4 (FIG. 1). The surfaces of the opposite faces 64 - 65, on the other hand, are grooved in profiles, shown respectively by the greatly enlarged details of FIGS. 11*a* and 11*b* of the section taken on the plane 70 (FIG. 11*c*), in such manner as to form a complete series of microprisms 60 disposed perpendicularly to the axis of rotation 7, with one of their faces, the facet 68, inclined with respect to the said axis of rotation 7 by the same angle $\alpha$ shown in FIG. 3, and one face 69 substantially perpendicular with respect to the said axis of rotation 7. Therefore, the facets 68 produce a refraction effect and, consequently, a shifting of the virtual image of the LED 2 which is entirely equivalent to that produced by the faces 11 - 12 of the transparent prismatic element 4 of FIG. 1. The third pair of opposite faces 66 - 67 is grooved in similar manner to the pair 64-65, except for the greater inclination of the facets 68 of the microprisms 60, corresponding to the angle $\beta$ of FIG. 3*a* - 3*e*, so that the pair of opposite faces 66 - 67 produces a refraction effect and, consequently, a shifting of the virtual image of the LEDs 2 which is entirely equivalent to that produced by the faces 13 - 14 of the transparent prismatic element 4 of FIG. 1.

Compared with the transparent prismatic element 4 of FIG. 1 to which it is optically equivalent, the transparent hexagonal prism 61 of FIG. 10 has a number of advantages. In the solution of FIG. 1, the inclination of the faces of the transparent prismatic element 4 imposes an increase in the distance between the axis of rotation 7 and the LEDs 2, leading to an increase in the dimensions of the visual display unit and setting a limit to the maximum length of the said transparent prismatic element 4 and, therefore, to the maximum number of characters which can be visually displayed. Moreover, in contrast to the transparent prismatic element 4, the transparent hexagonal prism 61 is perfectly balanced, as a result of which it does not require the use of special expedients for the purpose of avoiding vibration during rotation. Instead of single prism with inclined or faceted faces, it is clear that a plurality of prisms could be employed.

It is obvious that, without departing from the scope of the invention, the transparent prismatic element 4 may be shaped in many other alternative ways, such as, for example, with a number of faces different to six, or with a different inclination of the faces, or with the faces convex or concave instead of plane, as shown diagrammatically in FIGS. 12*a* and 12*b*.

With the special prismatic element of FIG. 12*a*, the virtual images of the dots forming the character matrix are brought closer to one another in the vertical direction than with the transparent prismatic element 4 of FIG. 1, while the images of the dots are more spaced apart with a prismatic element shaped in accordance with the profile of FIG. 12*b*.

By using a prismatic element different to the element 4 of FIG. 1, in particular with a number of faces different to six and with a different inclination of the faces with respect to the axis of rotation 7, the image of the character can be obtained with a number of rows or columns different to that of the example, the number of teeth in each group of teeth 18 of the synchronizing disc 5 and the total number of the groups of teeth 18 being also changed correspondingly.

It is also possible to use more than one LED 2, for example two, for each of the characters to be visually displayed, or, on the other hand, to use a single LED 2 to form more than one character, for example two characters. Moreover, as sources of modulated light, it is possible to replace the LEDs 2 by different devices such as, for instance, liquid crystal cells or plasma devices, with a substantially point luminous discharge in a gas.

Figure 13:
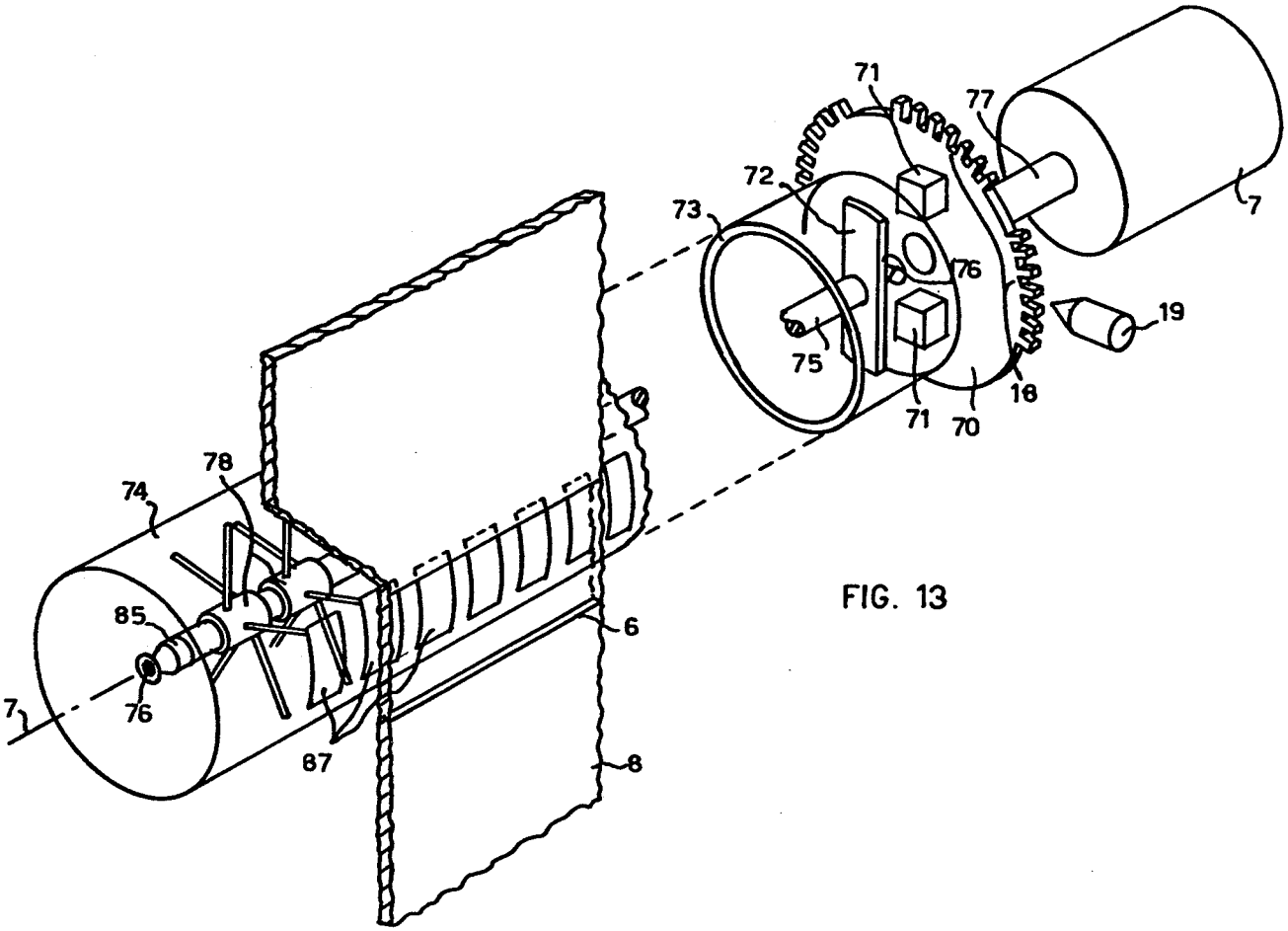
FIG. 13 shows in axonometric form a further visual display unit embodying the invention with a plasma tube having rotating electrodes.

With plasma devices, an integrated solution alternative to that of FIG. 1, which is illustrated in FIG. 13, is particularly interesting. The motor 3 is the same as in FIG. 1. Also, the synchronizing disc 70 keyed on the shaft 77 of the motor 3 is similar to the synchronizing disc 5 of FIG. 1; in addition, the synchronizing disc 70 bears two small magnets 71 which serve to rotate in synchronism a magnetized shoe 72 located inside the glass bulb 73 of a plasma tube 74. The magnetized shoe is mounted on a spindle 75 of conductive material coaxial with the axis of rotation 7 and supported by a pair of needle bearings 76. The spindle 75 of conductive material bears as many rotating electrodes 78 as there are characters to be visually displayed, which are disposed aligned with a centre-to-centre distance equal to that desired for the alphanumeric characters.

Figure 14B:
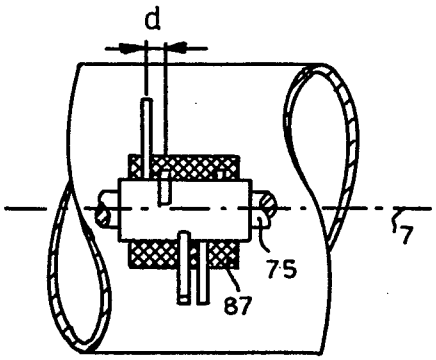
FIGS. 14*a* and 14*b* are detailed representations of the rotating electrodes of the plasma tube of FIG. 13.
Figure 14A:
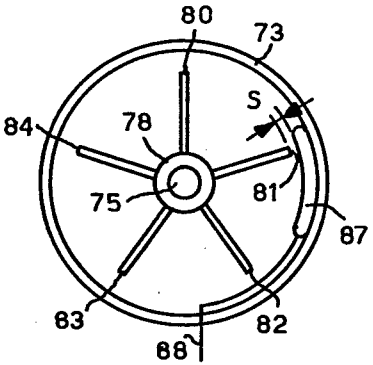

Each of the rotating electrodes 78, which are illustrated in detail in FIG. 14*a* and 14*b*, bears five points or pins 80, 81, 82, 83, 84 of conductive material resistant to the discharge in the gas which are arranged in a spiral at 72° one from the other and with a centre-to-centre distance *d* (FIG. 14*b*) equal to the distance between the columns of the matrix of the characters to be visually displayed. Through the medium of a sliding contact 85 (FIG. 15), the rotating electrodes 78 lead to a common supply terminal 86.

Corresponding with each of the rotating electrodes 78, for each of the characters to be visually displayed, counterelectrodes 87 are applied to the inside of the wall of the glass bulb 73 and lead to an equal number of terminals 88 (FIG. 15) for connection to the driving circuit, these counterelectrodes being constituted, for example, by thin metal grids of dimensions equal to those of the character matrix and disposed aligned with the observation window 6 formed in the protective cover 8. The distance *s* between the pins 80 - 84 of the rotating electrodes 78 and the counterelectrodes 87 (FIG. 14*a*) is such as to permit the formation of the luminous discharge in the gas of the plasma tube 74 with a striking voltage of low value.

Figure 15:
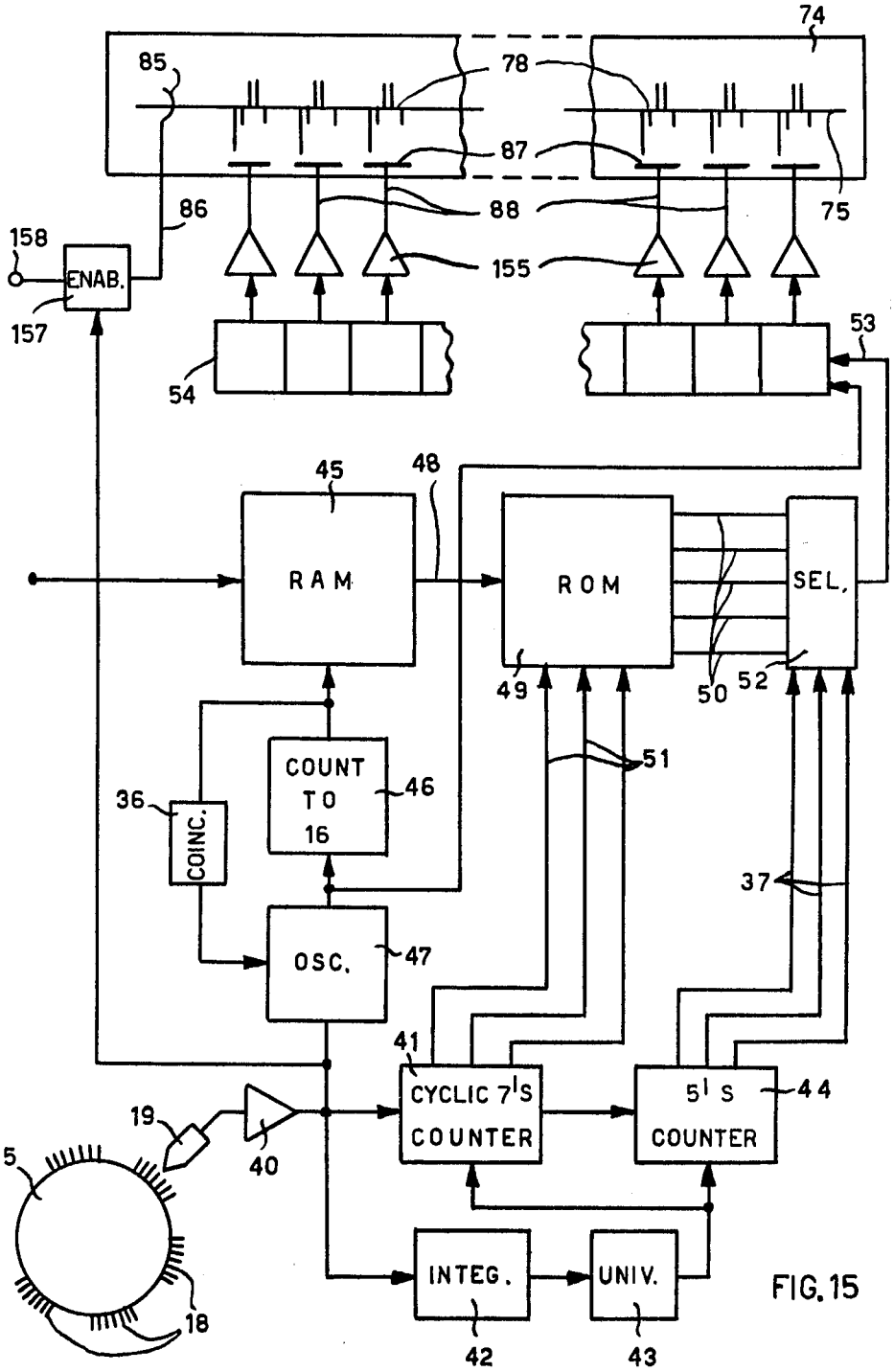
FIG. 15 is a block diagram of the driving circuit of the visual display unit of FIG. 13.

The driving circuit of the visual display unit of FIG. 10 is shown in FIG. 15. It is similar to the driving circuit of FIG. 5, to which reference is also made for the purpose of the description, except for the circuits 155 which produce the luminous discharge in the plasma element 74, which are different to the circuits 55 commanding the lighting of the LEDs 2 of FIG. 5 solely as regards the different voltage and current values required. In the circuit of FIG. 15, for the supply of the plasma element 74, there is required a supply separate from that of the logic and able to provide a voltage 158 of the order of 70 V and, of course, a corresponding adaptation of the amplifying circuits 155 and enabling circuit 157 with respect to the amplifying circuits 55 and enabling circuit 57 of FIG. 5.

The operation of the circuit of FIG. 15 is also very similar to that of the circuit of FIG. 5. Only the scanning sequence of the columns of the character changes, in the case of the arrangement of the five pins 80 - 84 of the discharge elements 78 being in the form of a spiral as shown in FIG. 14*b*, which requires the successive scanning of the five columns starting from the first, instead of the sequence IV, V, III, II, I required for the solution of FIG. 1 as described.

Figure 16:
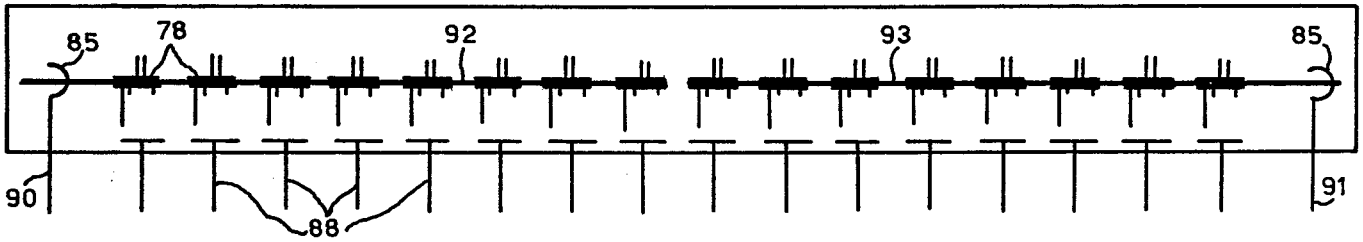
FIG. 16 shows diagrammatically a modified form of the plasme tube of FIG. 13.

The visual display unit of FIG. 13 may also be modified in accordance with an arrangement similar to that of FIG. 8 for multiplex operation, with the same advantages of economy. A structural modification of the plasma element 74 of FIG. 13 is required, with sub-division of the discharge elements 78 into two groups of eight elements 92 and 93 (FIG. 16) isolated from one another and respectively leading through sliding contacts 85 to two separate terminals 90 - 91 (FIG. 16) instead of to the single terminal 86 of FIG. 15.

Other modifications may be made in the device shown in FIG. 13, for example modifications concerning the number of rows and columns in the matrix, their scanning sequence and multiplexing, without thereby departing from the scope of the invention as claimed.

What we claim is:

1. An electronic visual display unit for displaying alphanumeric characters in at least one display cell each defined by one dot matrix, each dot matrix comprising a number of dots, said unit comprising:

modulatable means for irradiating light including at least one light source for each individual display cell, wherein the number of dots in each dot matrix being greater than the number of light sources associated therewith;

scanning means receptive of the light from the light sources of each display cell for optically and variably deflecting directly to an observer the images of the light sources of each individual display cell in a number of successive dot positions defining a predetermined dot matrix whereby virtual images of the light sources are displayed to the observer; and control circuit means receptive of character code signals for each display cell corresponding to characters to be displayed and synchronized to said scanning means for controlling the light irradiating means to modulate the light from the light sources for each display cell to selectively enable the irradiating of predetermined dot positions in each dot matrix corresponding to the character to be displayed in the display cell associated therewith.

2. A display unit according to claim 1, wherein the light sources emit light at fixed positions and the scanning means produce said virtual images of each of the light sources at the succession of dot positions.

3. A display unit according to claim 2, wherein the scanning means comprises at least one prismatic element disposed in the light path from the light sources and means rotatably mounting the element about an axis of rotation to effect the formation of said virtual images of the light sources at the different dot positions.

4. A visual display unit according to claim 3, wherein the prismatic element includes refelective faces which define the virtual images.

5. A visual display unit according to claim 3, wherein the prismatic element is transparent with a refractive index other than unity and wherein the light paths pass through the prismatic element.

6. A display unit according to claim 3, wherein the prismatic element has a plurality of faces which displace the virtual images in a direction perpendicular to the axis of rotation in response to the rotation thereof and wherein the faces have differing inclinations with respect to the axis of rotation which additionally displace the virtual images parallel to the axis of rotation.

7. A display unit according to claim 1 wherein the said light sources comprise light emitting diodes.

8. A display unit according to claim 1 wherein the modulatable means comprises at least one source of non-modulated light and an electro-optical device interposed in the light path for modulating the light therefrom.

9. A display unit according to claim 1, wherein each light source comprises a point luminous discharge in a gas.

10. A display unit according to claim 1, wherein each light source comprises a fixed electrode and a plurality of rotatable electrodes disposed on said scanning means and between any of which and the fixed electrode a discharge may be effected to emit light and wherein said control circuit means includes means positioning the rotatable electrodes axially displaced relative to each other and circumferentially distributed about the axis of rotation.

11. A display unit according to claim 10, wherein the electrodes are electrodes of a plasma tube and the movable electrodes are enabled by the control circuit means to produce selectively point luminous discharges with respect to fixed electrodes disposed inside the plasma tube.

12. A visual display unit according to claim 1, wherein there are at least two display cells and wherein said control circuit means includes means for driving at least two dot matrices in multiplex.

13. A display unit according to claim 3, wherein said prismatic element is provided with a set of similar faces parallel to the axis of rotation, each of said faces being grooved as to form a series of elongated microprisms disposed perpendicular to the axis of rotation of said prisim, wherein at least one of the surfaces of each microprism is inclined with respect to said axis to additionally displace said virtual images parallel to said axis.

* * * * *